US012693033B2

(12) United States Patent
Yuill et al.

(10) Patent No.: US 12,693,033 B2
(45) Date of Patent: Jul. 28, 2026

(54) VIRTUAL SUPERHEAT MEASUREMENT SENSOR FOR REFRIGERATION CYCLE

(71) Applicant: NUtech Ventures, Lincoln, NE (US)

(72) Inventors: David P. Yuill, Omaha, NE (US); Seyed Ali Rooholghodos, Omaha, NE (US)

(73) Assignee: NUtech Ventures, Lincoln, NE (US)

( * ) Notice: Subject to any disclaimer, the term of this patent is extended or adjusted under 35 U.S.C. 154(b) by 422 days.

(21) Appl. No.: 18/214,291

(22) Filed: Jun. 26, 2023

(65) Prior Publication Data

US 2023/0417429 A1 Dec. 28, 2023

Related U.S. Application Data

(60) Provisional application No. 63/355,447, filed on Jun. 24, 2022.

(51) Int. Cl.
*F24F 3/00* (2006.01)
*F24F 11/46* (2018.01)
(Continued)

(52) U.S. Cl.
CPC ..... *F24F 3/001* (2013.01); *F24F 11/46* (2018.01); *F24F 11/64* (2018.01); *F24F 2110/10* (2018.01); *F24F 2110/40* (2018.01)

(58) Field of Classification Search
CPC ..... F24F 11/46; F24F 11/64; F24F 2110/10; F24F 2110/40; F24F 3/001; F25B 2700/21151; F25B 2700/21152
See application file for complete search history.

(56) References Cited

U.S. PATENT DOCUMENTS 6,505,475 B1 * 1/2003 Zugibe ..... F24F 11/62 62/126
7,631,508 B2 12/2009 Braun et al.
(Continued)

FOREIGN PATENT DOCUMENTS

EP 2194344 A1 * 6/2010 ..... F25B 41/35

OTHER PUBLICATIONS

Kim et al., "Development, implementation, and evaluation of a fault detection and diagnostics system based on integrated virtual sensors and fault impact models," *Energy and Buildings*, 228: 110368, 27 pp. (Dec. 1, 2020).

(Continued)

*Primary Examiner* — Nelson J Nieves
(74) *Attorney, Agent, or Firm* — Leydig, Voit & Mayer, Ltd.

(57) ABSTRACT

A method for determining superheat for an air-conditioning system or a heat pump system using a virtual superheat measurement system. The method includes a obtaining a compressor efficiency; acquiring concurrent noninvasive measurements of a suction, a discharge, and a condensing temperature; determining a discharge pressure as a saturated pressure corresponding to the condensing temperature; determining a first discharge enthalpy and a discharge entropy as functions of the discharge temperature and the calculated discharge pressure; for all possible values of suction pressure: guessing the suction pressure; determining a suction enthalpy and a suction entropy as functions of guessed suction pressure and suction temperature; determining a second discharge enthalpy as a function of the discharge pressure and the calculated suction entropy; and determining a second compressor efficiency as the difference between the second discharge enthalpy and the suction (Continued)

enthalpy divided by the difference between the first discharge enthalpy and the suction enthalpy.

14 Claims, 7 Drawing Sheets

(51) Int. Cl.
*F24F 11/64* (2018.01)
*F24F 110/10* (2018.01)
*F24F 110/40* (2018.01)

(56) References Cited

U.S. PATENT DOCUMENTS

| | | | | |
|---|---|---|---|---|
| 9,651,286 | B2 | 5/2017 | Pham | |
| 9,803,902 | B2 | 10/2017 | Pham | |
| 9,885,507 | B2 * | 2/2018 | Pham | F25B 49/022 |
| 10,180,261 | B1 * | 1/2019 | Ross | F24F 11/30 |
| 10,228,172 | B2 | 3/2019 | Benedict, II et al. | |
| 2007/0163276 | A1 * | 7/2007 | Braun | F25B 49/005 62/149 |
| 2010/0205987 | A1 * | 8/2010 | Okazaki | F25B 9/008 62/190 |
| 2017/0082308 | A1 * | 3/2017 | Gokhale | F25D 21/02 |
| 2019/0009638 | A1 * | 1/2019 | Bonifaccino | B60H 1/3211 |
| 2021/0190401 | A1 * | 6/2021 | Fonte | F25B 49/02 |

OTHER PUBLICATIONS

Li et al., "Decoupling features and virtual sensors for diagnosis of faults in vapor compression air conditioners," *International J. of Refrigeration*, 30(3): 546-564 (May 2007).

Li et al., "Development, Evaluation, and Demonstration of a Virtual Refrigerant Charge Sensor," *HVAC&R Research*, 15(1): 117-136 (Jan. 2009).

Li et al., "Extending the virtual refrigerant charge sensor (VRC) for variable refrigerant flow (VRF) air conditioning system using data-based analysis methods," *Applied Thermal Engineering*, 93: 908-919 (Jan. 25, 2016).

* cited by examiner

VIRTUAL SUPERHEAT MEASUREMENT SENSOR FOR REFRIGERATION CYCLE

CROSS-REFERENCE TO RELATED APPLICATIONS

This patent application claims the benefit of U.S. Provisional Patent Application No. 63/355,447, filed Jun. 24, 2022, which is incorporated by reference in its entirety and for all purposes.

REGARDING FEDERALLY SPONSORED RESEARCH OR DEVELOPMENT

This invention was made with Government support under Grant Number DE-EE0008689 awarded by the United States Department of Energy. The Government has certain rights in this invention.

BACKGROUND

Air-conditioning systems and heat pumps are used in residential, commercial, and transportation settings, to cool air or heat air, and remove humidity. Air-conditioning systems and heat pumps often use a refrigeration cycle, which includes a compressor, a condenser (or condenser coil), a metering device (or expansion device), and an evaporator (or evaporator coil), connected as a sealed loop in the order listed to allow circulation of a refrigerant. The refrigeration cycle moves heat from a cooler region to a warmer region. Heat enters the cycle in the evaporator and leaves the cycle through the condenser. In cooling mode (for an air-conditioning system), the movement of heat into the evaporator is used, whereas in heating mode (for a heat pump) the movement of heat from the condenser is used. Common refrigerants include chlorofluorocarbons (CFCs, largely banned) like R-11, R-12, R-13, R-113, R-114, and R-115, hydrochlorofluorocarbons (HCFCs, being phased out) like R-22, R-123, R-124, and R-142b, hydrofluorocarbons (HFCs) like R-32, R-125, R-134a, R-143a, R-152a, and R410a (a 50/50 blend of R-32 and R-125), hydrofluoroolefins (HFOs), and hydrocarbons (HCs). Metering devices are located between the condenser and the evaporator, between the low-pressure side (or low side or suction side) and the high-pressure side (or high side or discharge side). Types of metering devices include capillary tube, fixed orifice, thermostatic expansion valve (TXV), and electronic expansion valve (EEV). Air-conditioning systems are designed to operate with a refrigerant charge level within a prescribed range, where the refrigerant charge level is the amount (or mass) of refrigerant contained within the system. The refrigerant charge level may fall outside the prescribed range for a number of reasons. The system may leak refrigerant due to a manufacturing defect or improper installation by a technician. A technician may overfill or underfill the system. If the refrigerant charge level drops below that range, the air-conditioning or heat pump system may have reduced cooling or heating capacity, reduced efficiency, poor humidity control, and reduced compressor life expectancy. In addition, when refrigerant is leaking to the atmosphere, the refrigerant causes environmental damage. If the refrigerant charge level exceeds the range (overcharging), the compressor may be damaged. Further, the capacity and the efficiency of the system may be reduced. Methods and systems exist for a technician to measure the refrigerant charge level. Normally two independent measured variables (for example, temperature and pressure) are needed to fix the state of the refrigerant, so that all other variables can be known. Pressure measurements are invasive by nature, requiring the sealed air-conditioning system to be breached with the inherent potential for loss of refrigerant. Lost refrigerant may produce an unsafe operating condition of the air-conditioning system, may incur an added expense for the servicer and/or owner of the system, and may have undesirable, deleterious effects on the environment. Further, making a pressure measurement requires the presence of a technician with its associated time delays and costs. Finally, the methods used by technicians do not quantify the amount of charge that is contained within the system; rather, they simply tell whether the refrigerant charge level is too high or too low. There exists a need to determine the superheat of the refrigeration cycle without needing to gain access to the interior of a residence or other area whose climate is being controlled and without breaching the sealed air-conditioning system as required for a pressure measurement.

BRIEF SUMMARY

One or more embodiments of the present disclosure provide a method for determining superheat for an air-conditioning system or a heat pump system using a virtual superheat measurement (VSM) system. The method comprising: providing a refrigerant; providing a compressor, having a compressor efficiency, configured to receive the refrigerant through a compressor inlet, to compress the refrigerant, and to discharge the refrigerant from a compressor outlet; providing a condenser operatively coupled to the compressor outlet via a discharge line; providing an evaporator operatively coupled to the condenser via a liquid line that contains a throttling device and to the compressor inlet via a suction line, where the refrigerant is capable of flowing in a closed loop from the compressor to the condenser to the evaporator and back to compressor; providing at least one temperature sensor configured to measure a suction temperature, a discharge temperature, and a condensing temperature in a cooling mode; and a suction temperature, discharge temperature, and evaporating temperature in a heating mode; providing storage configured to store data including the measured temperatures and instructions for a processor to perform a method for calculating the superheat; providing the processor that performs the method, the processor configured to receive the measured suction, discharge, and saturated temperatures, to calculate the superheat or subcooling, and to output the calculated superheat or subcooling to an output device; providing the output device.

The method in the cooling mode further includes: obtaining the compressor efficiency; acquiring concurrent noninvasive measurements of a suction temperature, a discharge temperature, and a condensing temperature; determining a discharge pressure as a saturated pressure corresponding to the condensing temperature; determining a first discharge enthalpy and a discharge entropy, each as functions of the discharge temperature and the calculated discharge pressure; looping through the following steps for all possible values of suction pressure:

- guessing the suction pressure;
- determining a suction enthalpy and a suction entropy, each as functions of the guessed suction pressure and the suction temperature;
- determining a second discharge enthalpy as a function of the discharge pressure and the calculated suction entropy; and
- determining a second compressor efficiency as the difference between the second discharge enthalpy and the suction enthalpy divided by the difference between the first discharge enthalpy and the suction enthalpy, where the method does not acquire a concurrent measurement of a refrigerant pressure made with a pressure sensor, the method does not include concurrent measurements on the evaporator, and the concurrent measurements are noninvasive.

The method in the heating mode further comprising: obtaining the compressor efficiency; acquiring concurrent noninvasive measurements of a suction temperature, a discharge temperature, and an evaporating temperature; determining an evaporating pressure as a saturated pressure corresponding to the evaporating temperature; determining a first suction enthalpy and a suction entropy, each as functions of the suction temperature and the calculated suction pressure; looping through the following steps for all possible values of discharge pressure:

guessing the discharge pressure;

determining a discharge enthalpy and a discharge entropy, each as functions of the guessed discharge pressure and the discharge temperature;

determining a second suction enthalpy as a function of the suction pressure and the calculated discharge entropy; and determining a second compressor efficiency as the difference between the second discharge enthalpy and the suction enthalpy divided by the difference between the first discharge enthalpy and the suction enthalpy;

wherein the method does not acquire a concurrent measurement of a refrigerant pressure made with a pressure sensor, the method does not include concurrent measurements on the condenser, and the concurrent measurements are noninvasive.

One or more embodiments disclose a virtual superheat measurement (VSM) system for predicting a refrigerant charge level of an air-conditioning system, the air-conditioning system comprising: a refrigerant; a compressor, having a compressor efficiency, configured to receive the refrigerant through a compressor inlet, to compress the refrigerant, and to discharge the refrigerant from a compressor outlet; a condenser operatively coupled to the compressor outlet via a discharge line; and an evaporator operatively coupled to the condenser via a liquid line and to the compressor inlet via a suction line, wherein the refrigerant is capable of flowing in a closed loop from the compressor to the condenser to the evaporator and back to compressor.

The VSM system includes: at least one temperature sensor configured to measure a suction temperature, a discharge temperature, and a condensing temperature; storage configured to store data including the measured temperatures and instructions for a processor to perform a method for calculating the refrigerant charge level; the processor that performs the method, the processor configured to receive the measured suction, discharge, and condensing temperatures, to calculate the refrigerant charge level, and to output to an output device at least one of the refrigerant charge level and a status indicator for the refrigerant charge level; and the output device, wherein the method for calculating the refrigerant charge level comprises:

obtaining the compressor efficiency;

acquiring rated values of the refrigerant charge level, a subcooling temperature, a superheat temperature, and a ratio of high-side charge to the total refrigerant charge at the rated charge level and rated operating conditions;

acquiring concurrent noninvasive measurements of a suction temperature, a discharge temperature, and a condensing temperature;

calculating the refrigerant charge level using the predetermined compressor efficiency or values used to derive the predetermined compressor efficiency, the acquired rated values, and the acquired concurrent measurements; and outputting at least one of the refrigerant charge level and a status indicator for the refrigerant charge level, wherein the method does not acquire a concurrent measurement of a refrigerant pressure made with a pressure sensor, and does not include concurrent measurements on the evaporator. The concurrent measurements are noninvasive.

One or more embodiments disclose a method for predicting a refrigerant charge level of an air-conditioning or heat pump system. The method comprising: providing the refrigerant; providing a compressor, having a compressor efficiency, configured to receive the refrigerant through a compressor inlet, to compress the refrigerant, and to discharge the refrigerant from a compressor outlet; providing a condenser operatively coupled to the compressor outlet via a discharge line; and providing an evaporator operatively coupled to the condenser via a liquid line and to the compressor inlet via a suction line, wherein the refrigerant is capable of flowing in a closed loop from the compressor to the condenser to the evaporator and back to compressor; obtaining the compressor efficiency; acquiring rated values of the refrigerant charge level, a subcooling temperature, a superheat temperature, and a ratio of high-side charge to the total refrigerant charge at the rated charge level and rated operating conditions; acquiring concurrent noninvasive measurements of a suction temperature, a discharge temperature, and a condensing temperature; calculating the refrigerant charge level using the predetermined compressor efficiency or values used to derive the predetermined compressor efficiency, the acquired rated values, and the acquired concurrent measurements; and outputting at least one of the refrigerant charge level and a status indicator for the refrigerant charge level. The method does not acquire a concurrent measurement of a refrigerant pressure made with a pressure sensor and does not include concurrent measurements on the evaporator. The concurrent measurements are noninvasive.

BRIEF DESCRIPTION OF THE SEVERAL VIEWS OF THE DRAWING(S)

DETAILED DESCRIPTION

While the present disclosure may refer to air-conditioning systems, it is to be understood that heat pumps are included unless explicitly excluded.

The present disclosure provides a low-cost and non-invasive means to evaluate the level of refrigerant charge using previously existing methods that estimate refrigerant charge level based upon superheat and subcooling measurements.

The virtual superheat measurement (VSM) sensor is a way to predict refrigerant superheat without using a pressure measurement, at a location in the refrigeration cycle that is difficult to measure using temperature sensors alone. For example, the VSM may be implemented without access to components located indoors, where access may be limited. In one or more embodiments of the present disclosure, the measurement may be accomplished using low-cost temperature measurements. The VSM allows an air-conditioning system's performance to be characterized by making only non-invasive measurements from only the outdoor part of a split system. A split air-conditioning system is one which consists of an outdoor portion of the system, including the condenser and the compressor, and an indoor portion that includes the evaporator. Outdoor, outdoors, or exterior is understood to be an area where such conditions as temperature and relative humidity (or dew point) are not controlled. Indoor, indoors, or interior is understood to be an area where one or more of these conditions may be controlled or where a system such as an air-conditioning system is configured to control one or more of these conditions.

Using the VSM approach, one may use temperature measurements from the condenser of an air conditioner, temperature measurements from the suction (that is, inlet) and discharge (that is, outlet) of the compressor, and an assumption about the compressor efficiency, to know that the evaporator pressure is, hence the amount of suction superheat in the system. By determining the suction superheat and the liquid line subcooling amount, the refrigerant charge level in the air conditioner or heat pump can be compared to the correct amount.

The VSM can be used, for example, as part of a method to determine whether an air conditioner or heat pump has too little or too much refrigerant.

The VSM can be used, for example, as a means to control an expansion valve to ensure that a desired amount of superheat is achieved under a variety of operating conditions.

An advantage of VSM approach is that the approach uses no pressure measurements, which are expensive and bring a risk of refrigerant leakage. A second advantage is that all of the measurements can be made on the outdoor part of a split-system air conditioner.

Figure 1:
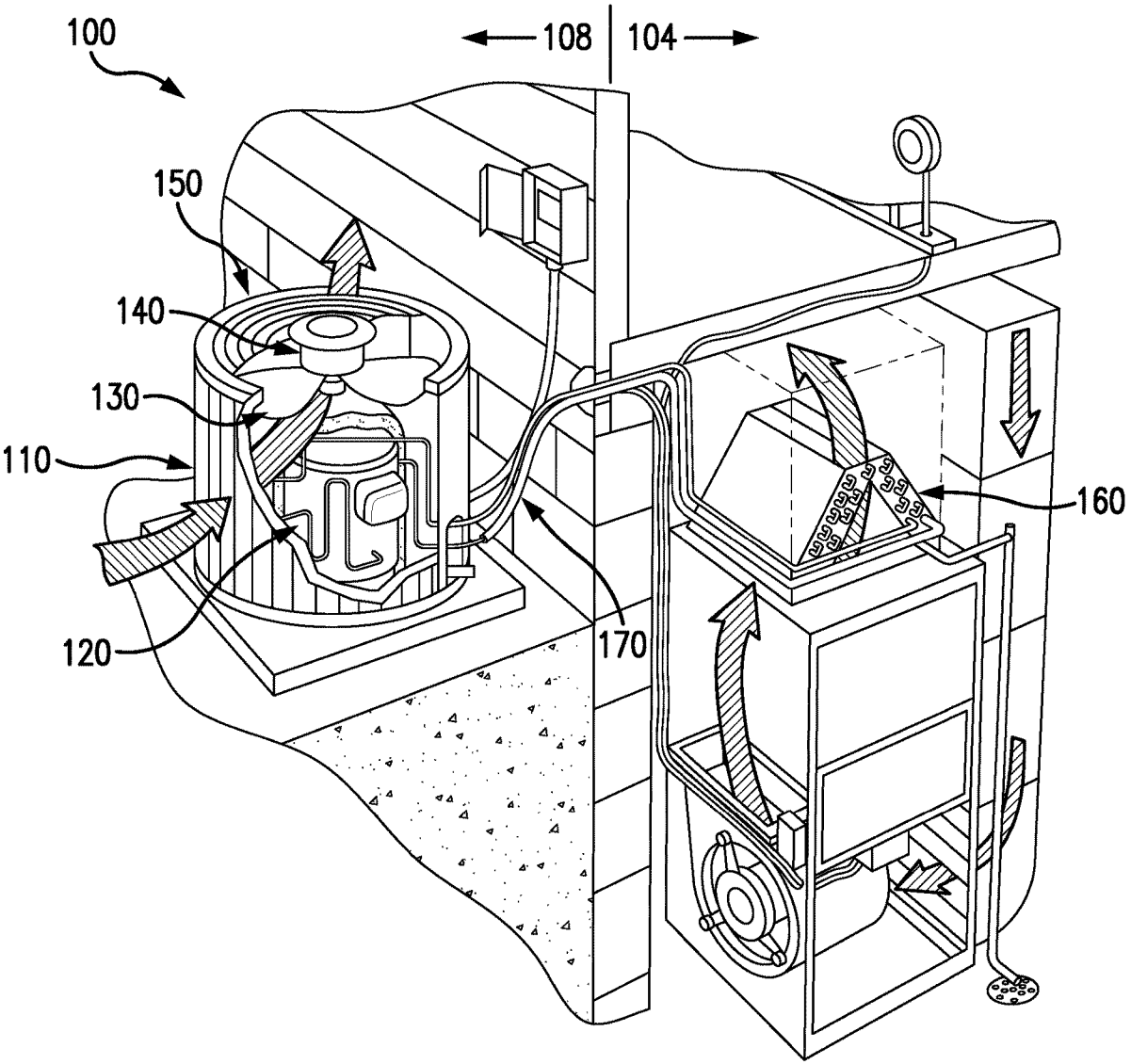
FIG. 1 shows a split air-conditioning system in accordance with one or more embodiments.

FIG. 1 provides a diagram of an air-conditioning system 100 similar to those found in residential settings, though other settings such as transportation, small commercial, grocery, among others, may also be included. The air-conditioning system represented in FIG. 1 may be described as a split system because some of the components are located indoors 104 while others are located outdoors 108, and those two parts of the system are connected by lines that enable the circulation of refrigerant between the various components. Specifically, a condenser 110, or condenser coil, and a compressor 120 are located outdoors. The compressor 120 and the condenser 110 along with a condenser fan 130 and fan motor 140 are sometimes considered as part of a condenser unit 150, which is located outdoors 108. An evaporator 160, or evaporator coil, may be located indoors 104. (Some air-conditioning systems may not be split, but may be a single packaged unit located outdoors. In such cases, the evaporator coil 160 would be located outdoors. However, VSM may be applied to such a packaged unit as well.) In the air-conditioning system 100, a central heating and cooling system circulates air through the residence. The indoor air is cooled as it passes over the evaporator 160. A refrigerant circulates in the system between the compressor 120, the condenser 110, and the evaporator 160 via refrigerant lines 170 (or, simply, lines).

Figure 2:
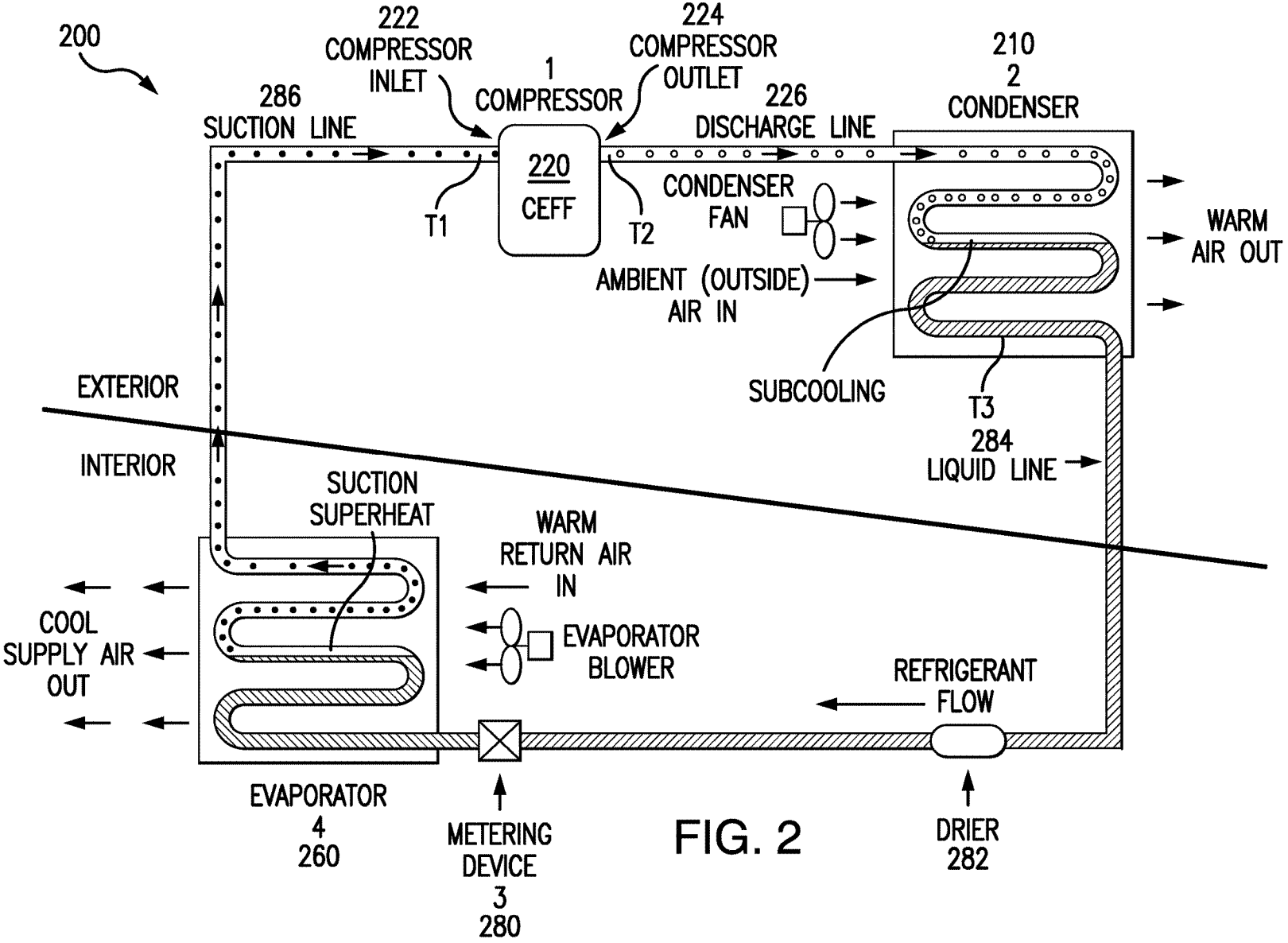
FIG. 2 shows a schematic diagram of an air-conditioning system in accordance with one or more embodiments.

FIG. 2 presents a schematic diagram of an air-conditioning system 200. In one or more embodiments, the air-conditioning system 200 may be a split system with a compressor 220 and condenser 210 outside the residence or building to be air-conditioned and a metering device (or throttling device) 280 and an evaporator 260 inside the residence or building, although not necessarily in an area of the residence or building that is being air-conditioned. In one or more embodiments, a drier 282 may be located on the liquid line 284 that runs between the condenser 210 and the metering device 280. The air-conditioning system 200 forms a closed loop containing refrigerant. The refrigerant enters the compressor 220, which has a compressor efficiency i, as a gas from the suction line 286 through the compressor inlet 222. The refrigerant gas is compressed by the compressor 220 and exits the compressor via the compressor outlet 224 into the discharge line 226. The discharge line 226 transports the gaseous refrigerant to the condenser 210. In the condenser 210, the refrigerant condenses into a liquid as it exchanges heat with outdoor air that passes over and through the condenser 210. The liquid refrigerant flows from the condenser 210, which may be outdoors, to the metering device 280, which may be indoors, via the liquid line 284. Before reaching the metering device 280, the liquid refrigerant may pass through a drier 282. The metering device 280, by changing the refrigerant from a liquid to a liquid-vapor mixture, allows the pressure and temperature of the refrigerant to drop before entering the evaporator 260. In the evaporator 260, warm indoor return air passes over the evaporator and is cooled. In exchange, the refrigerant in the evaporator 260 absorbs heat and changes phase from a liquid-vapor mixture to a gas before being discharged into the suction line 286 where, in one or more embodiments, the suction line 286 passes from indoors to outdoors. The gaseous refrigerant returns to the compressor inlet 222 via the suction line 286 to close the loop in the refrigeration cycle.

In one or more embodiments of the present disclosure, a suction temperature may be measured on the suction line 286. In particular, the suction temperature $T_{suc}$ may be measured on an exterior portion of the suction line 286. More particularly, the suction temperature may be measured at the compressor inlet 222. Further, a discharge temperature $T_{dis}$ may be measured on the discharge line 226. In particular, the discharge temperature may be measured at the compressor outlet 224. Further still, a condensing temperature $T_{cond}$ may be measured at the condenser 210. No other concurrent measurements, temperature or otherwise, are needed to determine the refrigerant charge level of the air-conditioning system 200. Thus, the required measurements may be made noninvasively from outdoors, without needing to go indoors, for example into a residence, which would require an occupant of the residence to be available. In addition, the temperature measurements may be made on the outer surfaces of the lines that carry the refrigerant, and so are noninvasive of the air-conditioning system 200. The noninvasive nature of the disclosed methods, systems, and apparatuses is in contrast to approaches which require pressure measurements, which are invasive of the air-conditioning system, and measurements at the evaporator, which are invasive of the residence.

One or more embodiments of the present disclosure provides a virtual superheat measurement (VSM) method for determining the superheat of an air-conditioning system. The superheat may be used in a calculation to determine a refrigerant charge level of an air-conditioning system. The method may be used to solve for $m_{total}$ in Equation 1:

$$\frac{m_{total} - m_{total,rated}}{m_{total,rated}} = \frac{1}{k_{ch}}\left\{(T_{SC} - T_{SC,rated}) - \frac{k_{SH}}{k_{SC}}(T_{SH} - T_{SH,rated})\right\} \quad (1)$$

where $$k_{ch} = \frac{m_{total,rated}}{k_{SC}} = \frac{T_{SC,rated}}{(1-\alpha_0)X_{hs,rated}} \quad (2)$$

and $m_{total}$ and $m_{total,rated}$ are actual and rated total refrigerant charge, $T_{SC}$ and $T_{SC,rated}$ are actual and rated subcooling, and $T_{SH}$ and $T_{SH,rated}$ are actual and rated superheat. $k_{SC}$ and $k_{SH}$ are empirical constants that depend on the condenser and evaporator geometries, and relate the refrigerant charge level in the high and low sides of the system to subcooling and superheat, respectively. The ratio $k_{SH}/k_{SC}$ is defined as:

$$\frac{k_{SH}}{k_{SC}} = \frac{T_{SH} - T_{SH,rated}}{T_{SC} - T_{SC,rated}} \quad (3)$$

$k_{ch}$ is a constant that may be determined through laboratory testing. The parameter $\alpha_0$ is the ratio of refrigerant charge at which there exists saturated liquid at the exit of the condenser coil at the rating condition to the rated refrigerant charge. $X_{hs,rated}$ is the ratio of high-side charge to the total refrigerant charge at the rated charge level and rated operating conditions. A typical value for $X_{hs,rated}$ is 0.73, and a value of 0.75 is appropriate for $\alpha_0$. These values can be used in place of laboratory testing with minor loss of accuracy.

Consequently, the refrigerant charge level of the air-conditioning system may be estimated through measuring $T_{SC}$, $T_{SH}$, and knowing these values for the rated condition. Rated conditions may be provided by the manufacturer of the air-conditioning system. When they are not, default values may be used. The rated condition refers to a particular operating condition (typically 95 degrees Fahrenheit (° F., 35 degrees Celsius (° C.)) outdoors and 80° F. (27° C.), 50% relative humidity indoors). The rating is defined by a test standard, Air-Conditioning, Heating, and Refrigeration Institute (AHRI) 210/240 or the federal government's equivalent, and results in a rated capacity, in British thermal units per hour (Btu/hr). The manufacturer may select the correct amount of charge—and resulting $T_{SC}$ and $T_{SH}$, to get the rating result they desire. To find $T_{SH}$, knowing $P_{suc}$ is required, but direct measurement of the pressure is invasive, and a direct pressure measurement can be itself a source of refrigerant charge leakage. This concern is particularly important when monitoring refrigerant charge over time because even a short-term release of refrigerant could be a problem. One or more embodiments of the method first estimates $P_{suc}$, and subsequently $T_{SH}$ without using a pressure sensor and accessing only the outdoor part of the air-conditioning system, and therefore, being very noninvasive. The method is based upon the assumption that isentropic efficiency of the compressor remains constant. In this method a one-time measurement of $T_{dis}$, $K_{cond}$, $T_{suc}$, $T_{LL}$, and $P_{suc}$ are used to calculate enthalpy at the inlet and outlet of the compressor, to determine the compressor efficiency, $\eta$. (If a manufacturer provides this one-time measurement is not necessary). After that, one can solve for the suction enthalpy to calculate $P_{suc}$, hence $T_{SH}$, hence apply Equations 1 to 3.

Figure 3:
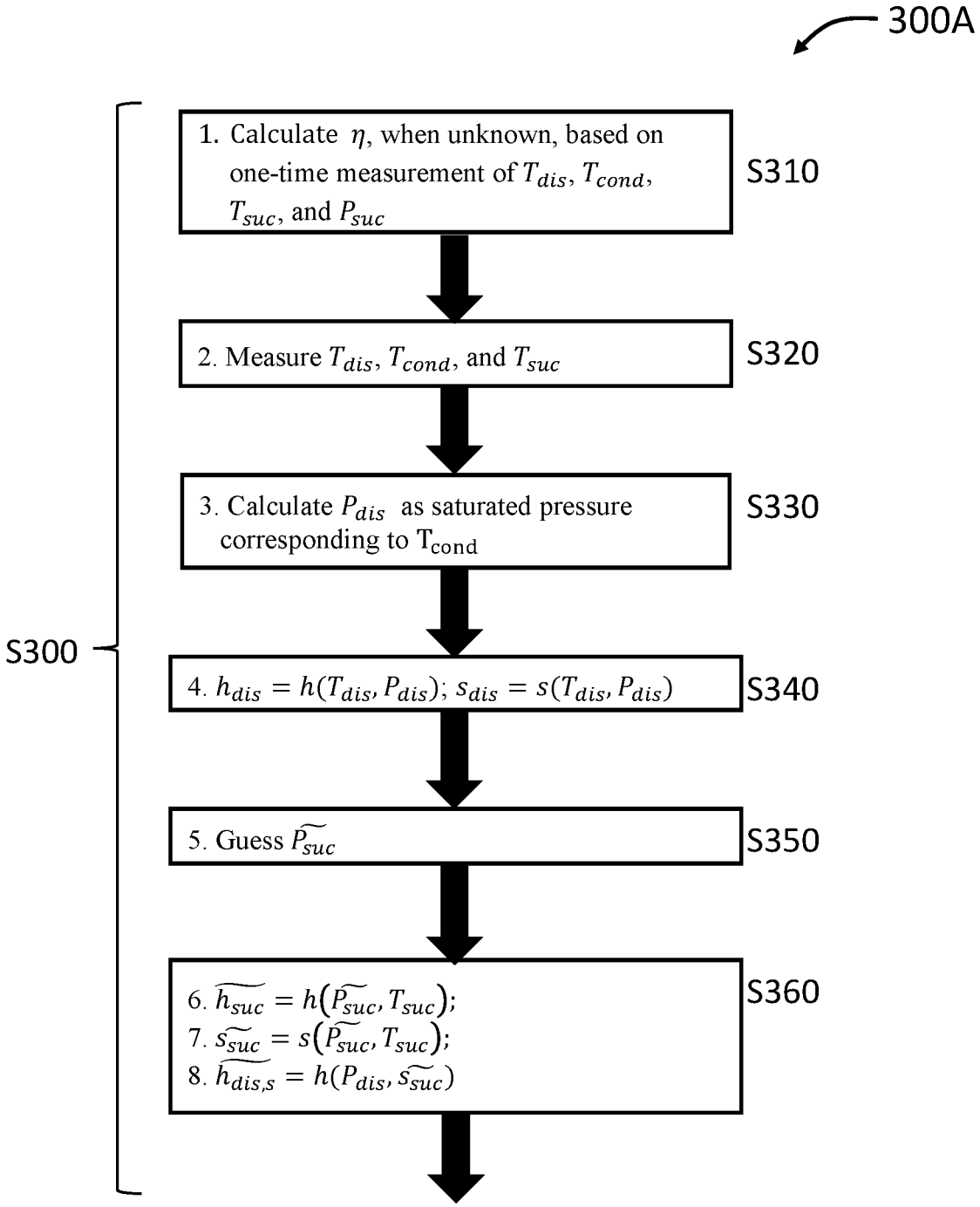
FIG. 3 shows a flowchart of a method for determining superheat of an air-conditioning system in accordance with one or more embodiments.
Figure 3:
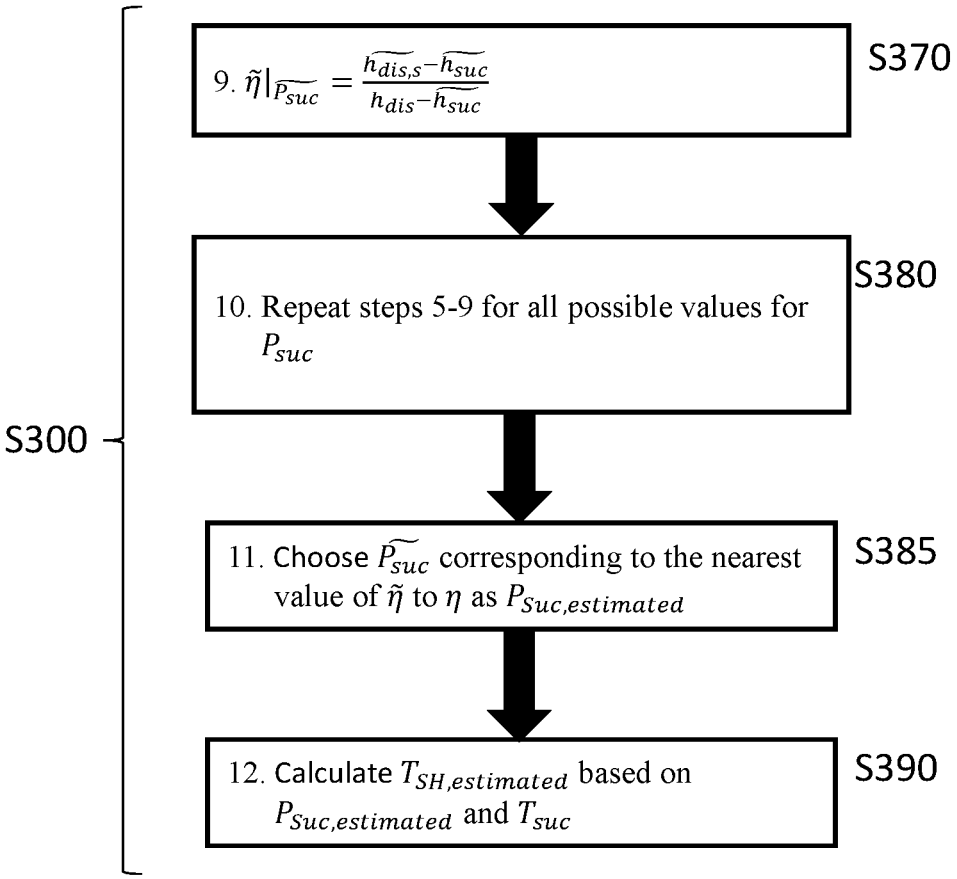

Referring to FIG. 3A, a method for predicting the superheat of an air-conditioning system is presented in a flowchart 300A. While the method may be presented in a particular order and with a particular numbering, it will be readily recognized that some steps of the method may be reordered and some may be undertaken simultaneously. Further, while intermediate results are shown in the flowchart 300A, one or more intermediate results may be bypassed by combining one or more calculations. In Step S310, the compressor efficiency $\eta$ is obtained. The compressor efficiency $\eta$ may be available from the compressor manufacturer. However, if the compressor efficiency $\eta$ has not been provided in such a manner, the compressor efficiency may be determined by making a one-time measurement of the discharge temperature, the condensing temperature, the suction temperature, and the suction pressure. The condensing temperature may be determined by measuring the condenser temperature. However, since some parts of the condenser are at different temperatures, one may measure the temperature of the condenser in a few places and choose the appropriate temperature as the condensing temperature.

At the time for which superheat, refrigerant charge level, or other related quantities are desired, temperature measurements are obtained for a discharge temperature, a suction temperature and a condensing temperature S320. These temperatures may be obtained non-invasively, for example, by placing temperature sensors on the outside surfaces of the refrigerant lines in the air-conditioning system. The discharge temperature and the suction temperature may be made at the compressor outlet 224 and compressor inlet 222, respectively. In some cases, because of the temperature of the compressor, the suction temperature may be measured along the suction line away from the compressor 220. Similarly, the discharge temperature may be made on the discharge line 226 away from the compressor 220.

In step S330, a discharge pressure may be determined as a saturated pressure corresponding to the condensing temperature. The saturated pressure is the pressure at which the refrigerant has a two-phase state (that is, a mixture of liquid and vapor). In this two-phase state, the pressure and the temperature are dependent. Thus, by having either the pressure or the temperature, the second can be found by thermodynamic data. For example, if refrigerant R134a is saturated at 20° C., then the pressure must be 572 kilopascals (kPa).

In Step S340, a first specific discharge enthalpy, hats, and a specific discharge entropy, $s_{dis}$, may be determined, each a function of the discharge temperature, $T_{dis}$, and the discharge pressure, $P_{dis}$.

In step S380, steps S350-S370 may be performed iteratively until all possible values of suction pressure have been used in the steps as follows:

In step S350, a value of the suction pressure is guessed, where a tilde represents values based on the loop of steps and the guessed value of suction pressure. At the suction temperature, all values of suction pressure between two limits are tried. One limit is the saturation line. The second limit is the suction pressure that corresponds to the calculated discharge entropy.

In step S360, a suction enthalpy and a suction entropy are each determined as functions of the guessed suction pressure and the suction temperature. Also, a second discharge enthalpy is determined as a function of the discharge pressure and the guessed suction enthalpy.

In step S370, a second compressor efficiency is calculated as the difference between the second discharge enthalpy and the suction enthalpy divided by the difference between the first discharge enthalpy and the suction enthalpy.

In step S385, the suction pressure determined during the loop S380 that corresponds to the value of the second compressor efficiency nearest to the compressor efficiency is selected as the estimated suction pressure.

In step S390, the estimated superheat is calculated based on the estimated suction pressure and the suction temperature.

For a heat pump in heating mode, the method can be used to determine subcooling using measurements from the same sensors. In this case, the indoor coil and outdoor coil reverse their roles, and discharge pressure becomes the unknown variable, so that the method is as follows:

$P_{suc}$ can be calculated based on $T_{evap}$ from measurements on the outdoor coil $h_{suc}$ and $s_{suc}$ are calculated based on $T_{suc}$ and $P_{suc}$ The value of $\widetilde{P_{dis}}$ is guessed, and $\widetilde{h_{dis}}$ is calculated based on the guessed value $\widetilde{h_{suc,s}}$ is calculated based on $s_{suc}$ and $\widetilde{P_2}$ $\widetilde{\eta_{II}}$ is found by using $$\widetilde{\eta_{II}} = \frac{\widetilde{h_{dis,s}} - h_{suc}}{\widetilde{h_{dis}} - h_{suc}}$$

The calculations are repeated for all values of possible pressure for $P_{dis}$

Figure 4:
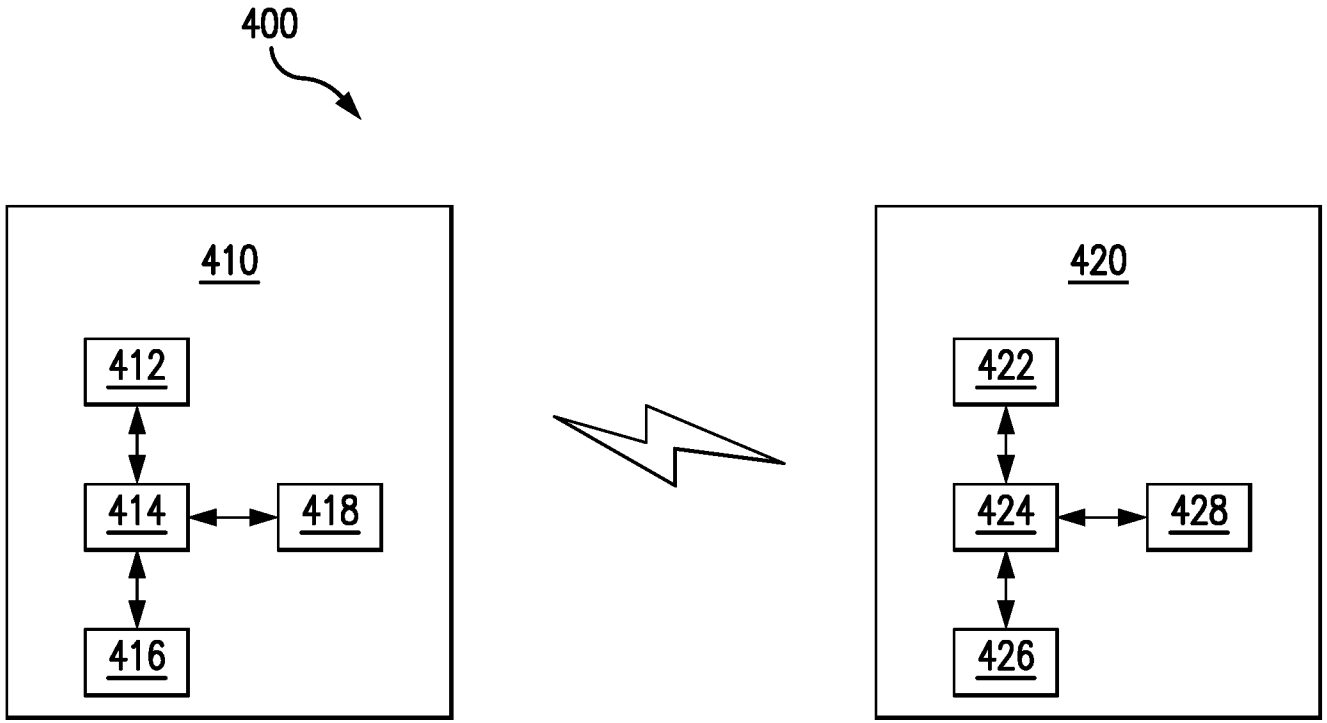
FIG. 4 shows a remote monitoring system for monitoring the refrigerant charge level of an air-conditioning system in accordance with one or more embodiments.

The final estimated value for $P_{dis}$ is the one corresponding to the closest value of $\widetilde{\eta_{II}}$ to $\eta_{II}$ Referring to FIG. 4, in one or more embodiments the refrigerant charge level of an air-conditioning system may be monitored remotely by using a virtual superheat measurement (VSM) system 400 that includes both a local subsystem 410 and a remote subsystem 420. The remote subsystem may be in a single location or may be distributed. For example, storage may be cloud storage and processing may include edge computing. Thus, processing and storage for the VSM system 400 may be distributed in one or more embodiments. The air-conditioning system may have temperature sensors 412 for measuring a suction temperature disposed on the suction line, a discharge temperature disposed on the discharge line, and a condensing temperature disposed on the condenser. These temperature sensors 412 may be disposed on the outside of the relevant lines. The temperature sensors may be disposed on outdoor portions of the air-conditioning system. The temperature sensors 412 for the suction and discharge temperatures may be disposed near the compressor inlet and outlet, respectively, of the air-conditioning system. As the compressor may be hot during operation, one may place the temperature sensors 412 for the suction and discharge temperatures a distance away from the compressor inlet and outlet. As a non-limiting example, the temperature sensors 412 may be placed 3 to 12 inches (7.6 to 30.5 centimeters (cm)) from the inlet or outlet. The temperature sensors 412 may communicate either analog or digital temperature information to a local processor 414. The local subsystem 410 may also include local storage 416. The local storage 416 may be include non-transitory computer readable media. The local storage 416 may include instructions to be executed by the local processor 414 to execute one or more methods disclosed herein for determining superheat, hence a refrigerant charge level for the air-conditioning system. The local storage 416 may also be used to store temperature data acquired by the temperature sensors 412, superheat, refrigerant charge level, a refrigerant charge level status, and the like. In one or more embodiments, temperature data acquired by the temperature sensors 412, refrigerant charge level, and refrigerant charge level status may be communicated by a local data interface 418 to the remote subsystem 420, specifically to a remote data interface 422. Communication between the local and remote data interfaces 418, 422 may be wired, wireless, a combination of wired and wireless, optical, and the like. Means of communication may include telephone lines, cellular communication, Ethernet, USB, serial or parallel data communication, and the like. Data communicated to the remote data interface 422 may be processed using a remote processor 424 and/or stored in remote storage 426. Remote storage 426 may include non-transitory computer readable media and may store instructions to be executed by the remote processor 424 to execute one or more methods disclosed herein for determining superheat, or a refrigerant charge level for the air-conditioning system. One may also use the determined superheat to control an electronic expansion valve or other controlled device in an air-conditioning system. The remote storage 426 may also be used to store temperature data acquired by the temperature sensors 412, refrigerant charge level, a refrigerant charge level status, and the like. The remote processor 424 may output temperature data, superheat amount, refrigerant charge level, refrigerant charge level status indicator and the like to an output device 428. The output device may be a display device such as a computer monitor, a TV screen, and the like. The output device may be a printer. The output device may also include a visible or audible alarm such as a flashing or steady light, a siren, or spoken voice, or other means of communicating to a user a refrigerant charge level and/or refrigerant charge level status.

Figure 5:
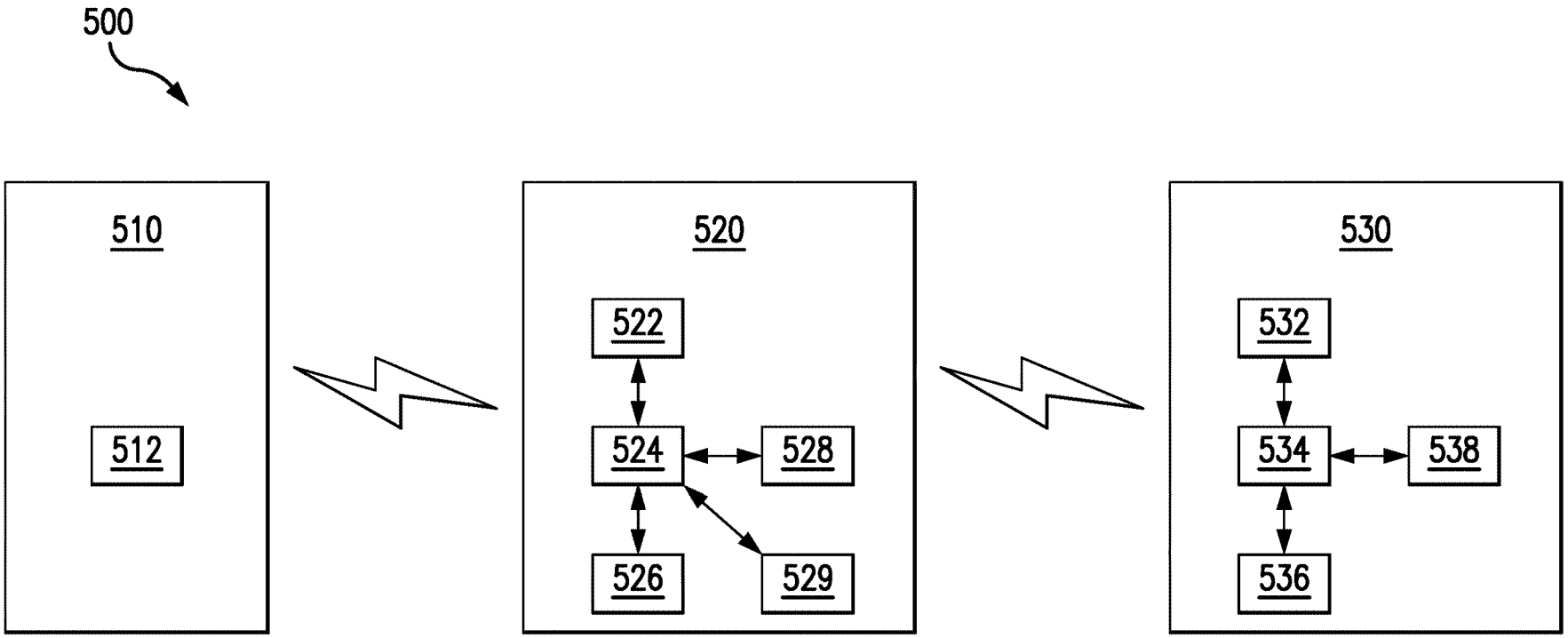
FIG. 5 shows a system for checking refrigerant charge level of an air-conditioning system where the checking system includes a local, portable device and a remote device in accordance with one or more embodiments.

Referring to FIG. 5, a system 500 for checking refrigerant charge level of an air-conditioning system 510 where the checking system 500 includes a local, portable device 520 and a remote portion 530. Temperature sensors 512 may be permanently disposed on the air-conditioning system 510. More specifically, these temperature sensors may be disposed to measure to measure a suction temperature, a discharge temperature, and a condensing temperature of the air-conditioning system 510. Details of placement of the temperature sensors 512 has been described previously and will not be repeated here. The local, portable device 520 may include a sensor interface 522 for communicating with temperature sensors 512, a local processor 524, local storage 526, and a local data interface 528 for communicating with the remote portion 530 of the system 500. The remote portion 530 may include a remote data interface 532, a remote processor 534, remote storage 536, and a remote output device 538. The local, portable device 520, the remote portion 530, their constituent parts and their interaction has been previously described and will not be repeated here. The local, portable device 520 may be used by a technician. In one or more embodiments, the local, portable device 520 may be handheld. The local, portable device 520 may include a user interface 529 that the technician, for example, may use. The user interface 529 may allow viewing the status of the temperature sensors 512, temperature data from those sensors, the status of the communication link to the remote portion 530, the refrigerant charge level of the air-conditioning system 510, a refrigerant charge level status, audible and visible alerts and warnings, and the like. Functionality of the checking system may be distributed between the local, portable device 520 and the remote portion 530 so that storage and processing may occur at one or both locations, or a combination of the locations. The sensor interface 522 may allow one or more of wire or wireless communication with the temperature sensors 512. Optical fiber may be used for communication. The temperature sensors may communicate either analog or digital temperature data to the sensor interface. The temperature sensors 512 may be installed during the manufacturing or installation of the air-conditioning system 510, or may be installed by the monitoring and/or servicing provider(s) at a later time.

Figure 6:
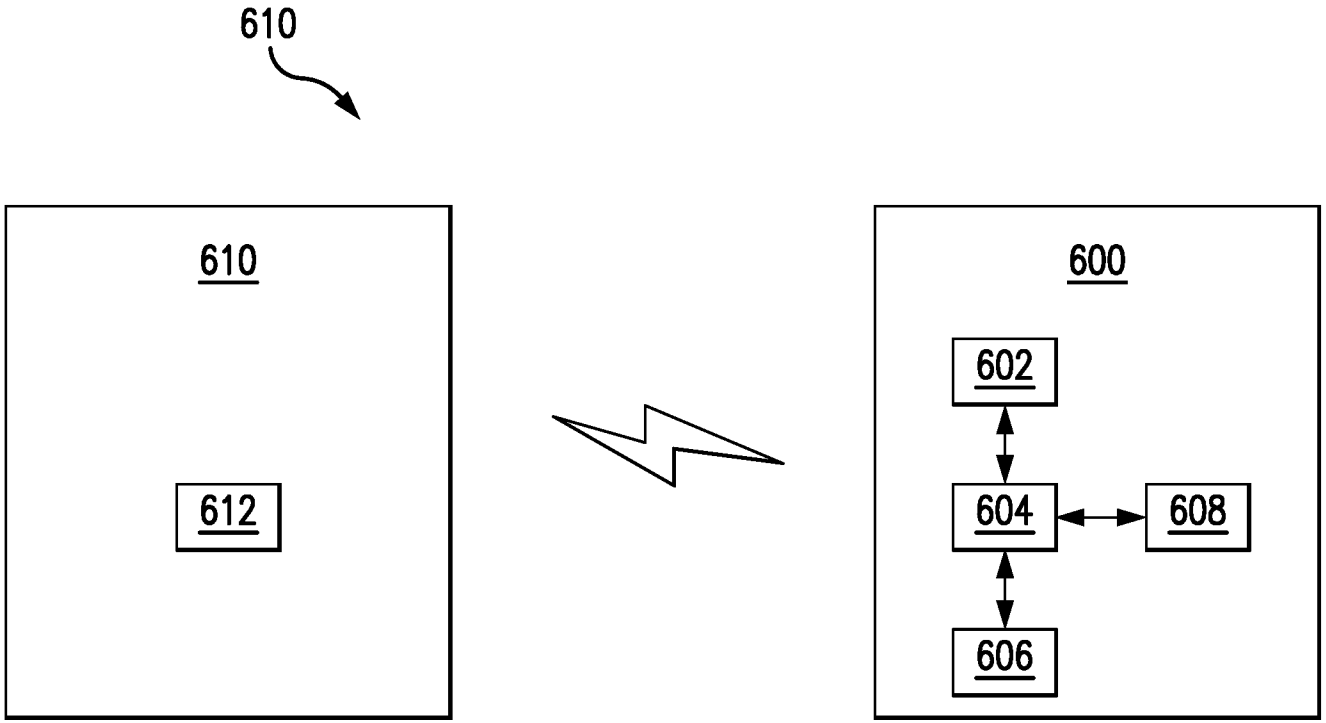
FIG. 6 shows a local, portable system for checking refrigerant charge level of an air-conditioning system in accordance with one or more embodiments.

Referring to FIG. 6 shows a schematic diagram of a local, portable system 600 for checking refrigerant charge level of an air-conditioning system 610. Temperature sensors 612 may be permanently or temporarily disposed on the air-conditioning system 610 for measuring a suction temperature, a discharge temperature, and a condensing temperature. The local, portable system 600 may include a sensor interface 602 for communicating with temperature sensors 612, a processor 604, storage 606, and a user interface 608. Features of the local, portable system 600, the temperature sensors, their functionality, their interaction with each other and the air-conditioning system 610 have been previously described herein and will not be repeated.

The following examples further illustrate the one or more embodiments of the present disclosure but, of course, should not be construed as in any way limiting its scope.

The systems, apparatuses, and methods disclosed herein are applicable for determining superheat and/or predicting a refrigerant charge level of an air-conditioning system, a heat pump, or any apparatus operating on similar principles and are not limited to split air-conditioning systems.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for determining superheat for an air-conditioning system or a heat pump system using a virtual superheat measurement (VSM) system, the method comprising:

providing a refrigerant;

providing a compressor, having a compressor efficiency, configured to receive the refrigerant through a compressor inlet, to compress the refrigerant, and to discharge the refrigerant from a compressor outlet;

providing a condenser operatively coupled to the compressor outlet via a discharge line;

providing an evaporator operatively coupled to the condenser via a liquid line that contains a throttling device and to the compressor inlet via a suction line, wherein the refrigerant is capable of flowing in a closed loop from the compressor to the condenser to the evaporator and back to compressor;

providing at least one temperature sensor configured to measure a suction temperature, a discharge temperature, and a condensing temperature in a cooling mode; and a suction temperature, discharge temperature, and evaporating temperature in a heating mode;

providing storage configured to store data including the measured suction, discharge, and condensing temperatures and instructions for a processor to perform a method for calculating the a superheat or supercooling;

providing the processor that performs the method, the processor configured to receive the measured suction, discharge, and saturated temperatures, to calculate the superheat or subcooling, and to output the calculated superheat or subcooling to an output device;

providing the output device, the method in the cooling mode further comprising:

obtaining the compressor efficiency;

acquiring concurrent noninvasive measurements of a suction temperature, a discharge temperature, and a condensing temperature;

determining a discharge pressure as a saturated pressure corresponding to the condensing temperature;

determining a first discharge enthalpy and a discharge entropy, each as functions of the discharge temperature and the calculated discharge pressure;

looping through the following steps for all possible values of suction pressure:

guessing the suction pressure;

determining a suction enthalpy and a suction entropy, each as functions of the guessed suction pressure and the suction temperature;

determining a second discharge enthalpy as a function of the discharge pressure and the calculated suction entropy; and determining a second compressor efficiency as a difference between the second discharge enthalpy and the suction enthalpy divided by a difference between the first discharge enthalpy and the suction enthalpy, wherein the method does not acquire a concurrent measurement of a refrigerant pressure made with a pressure sensor, wherein the method does not include concurrent measurements on the evaporator, and wherein the concurrent measurements are noninvasive;

the method in the heating mode further comprising:

obtaining the compressor efficiency;

acquiring concurrent noninvasive measurements of a suction temperature, a discharge temperature, and an evaporating temperature;

determining an evaporating pressure as a saturated pressure corresponding to the evaporating temperature;

determining a first suction enthalpy and a suction entropy, each as functions of the suction temperature and the calculated suction pressure;

looping through the following steps for all possible values of discharge pressure:

guessing the discharge pressure;

determining a discharge enthalpy and a discharge entropy, each as functions of the guessed discharge pressure and the discharge temperature;

determining a second suction enthalpy as a function of the suction pressure and the calculated discharge entropy; and determining a second compressor efficiency as a difference between the second discharge enthalpy and the suction enthalpy divided by a difference between the first discharge enthalpy and the suction enthalpy;

wherein the method does not acquire a concurrent measurement of a refrigerant pressure made with a pressure sensor, wherein the method does not include concurrent measurements on the condenser, and wherein the concurrent measurements are noninvasive.

2. A virtual superheat measurement (VSM) system for predicting a refrigerant charge level of an air-conditioning system, the air-conditioning system comprising:

a refrigerant;

a compressor, having a compressor efficiency, configured to receive the refrigerant through a compressor inlet, to compress the refrigerant, and to discharge the refrigerant from a compressor outlet;

a condenser operatively coupled to the compressor outlet via a discharge line; and an evaporator operatively coupled to the condenser via a liquid line and to the compressor inlet via a suction line, wherein the refrigerant is capable of flowing in a closed loop from the compressor to the condenser to the evaporator and back to compressor, the VSM system comprising:

at least one temperature sensor configured to measure a suction temperature, a discharge temperature, and a condensing temperature;

storage configured to store data including the measured temperatures and instructions for a processor to perform a method for calculating the refrigerant charge level;

the processor that performs the method, the processor configured to receive the measured suction, discharge, and condensing temperatures, to calculate the refrigerant charge level, and to output to an output device at least one of the refrigerant charge level and a status indicator for the refrigerant charge level;

and the output device, wherein the method for calculating the refrigerant charge level comprises:

obtaining the compressor efficiency;

acquiring rated values of the refrigerant charge level, a subcooling temperature, a superheat temperature, and a ratio of high-side charge to a total refrigerant charge at the rated charge level and rated operating conditions;

acquiring concurrent noninvasive measurements of a suction temperature, a discharge temperature, and a condensing temperature;

calculating the refrigerant charge level using the predetermined compressor efficiency or values used to derive the predetermined compressor efficiency, the acquired rated values, and the acquired concurrent measurements; and outputting at least one of the refrigerant charge level and a status indicator for the refrigerant charge level, wherein the method does not acquire a concurrent measurement of a refrigerant pressure made with a pressure sensor, wherein the method does not include concurrent measurements on the evaporator, and wherein the concurrent measurements are noninvasive.

3. The VSM system of claim 2, wherein the at least one temperature sensor comprises at least one temperature sensor configured to measure the suction temperature, at least one temperature sensor configured to measure the discharge temperature, and at least one temperature sensor configured to measure the condensing or evaporating temperature, depending on whether the system is cooling or heating.

4. The VSM system of claim 2, wherein part or all of the VSM system is portable.

5. The VSM system of claim 4, wherein the portable section of the system is handheld.

6. A method for predicting a refrigerant charge level of an air-conditioning or heat pump system, the method comprising:

providing a refrigerant;

providing a compressor, having a compressor efficiency, configured to receive the refrigerant through a compressor inlet, to compress the refrigerant, and to discharge the refrigerant from a compressor outlet;

providing a condenser operatively coupled to the compressor outlet via a discharge line; and providing an evaporator operatively coupled to the condenser via a liquid line and to the compressor inlet via a suction line, wherein the refrigerant is capable of flowing in a closed loop from the compressor to the condenser to the evaporator and back to compressor;

obtaining the compressor efficiency;

acquiring rated values of the refrigerant charge level, a subcooling temperature, a superheat temperature, and a ratio of high-side charge to a total refrigerant charge at the rated charge level and rated operating conditions;

acquiring concurrent noninvasive measurements of a suction temperature, a discharge temperature, and a condensing temperature;

calculating the refrigerant charge level using the predetermined compressor efficiency or values used to derive the predetermined compressor efficiency, the acquired rated values, and the acquired concurrent measurements; and outputting at least one of the refrigerant charge level and a status indicator for the refrigerant charge level, wherein the method does not acquire a concurrent measurement of a refrigerant pressure made with a pressure sensor, wherein the method does not include concurrent measurements on the evaporator, and wherein the concurrent measurements are noninvasive.

7. The method of claim 6, wherein the air-conditioning system is a split system with the compressor and the condenser are located outside, the evaporator is located inside, and the refrigerant lines pass between the outside and the inside.

8. The method of claim 6, wherein the heat pump system is a split system with the compressor and the evaporator located outside, the condenser is located inside, and refrigerant-carrying lines pass between the outside and the inside.

9. The method of claim 6, wherein the suction temperature is measured at a position along the suction line and the discharge temperature is measured at a position along the discharge line.

10. The method of claim 9, wherein both the position along the suction line and the position along the discharge line are outside.

11. The method of claim 10, wherein the position along the suction line is at the compressor inlet and the position along the discharge line is at the compressor outlet.

12. The method of claim 11, wherein the suction and discharge temperatures are measured by suction and discharge temperature sensors that are disposed on the suction line and the discharge line, respectively.

13. The method of claim 6, wherein the suction and discharge temperatures are measured noninvasively.

14. The method of claim 6, wherein predetermining the compressor efficiency comprises at least one of obtaining the compressor efficiency directly or indirectly from a manufacturer of the air-conditioning system or calculating the compressor efficiency using a one-time measurement of only a discharge temperature, a suction temperature, a condensing temperature, a liquid line temperature and a suction pressure.

* * * * *